United States Patent [19]

Brush

[11] 4,133,128

[45] Jan. 9, 1979

[54] SAFETY DEVICE FOR RIFLES

[76] Inventor: Clyde E. Brush, P.O. Box 222, Delta, Utah 84624

[21] Appl. No.: 825,601

[22] Filed: Aug. 18, 1977

[51] Int. Cl.[2] ..... F41C 17/08

[52] U.S. Cl. ..... 42/70 R; 42/70 F; 39/143

[58] Field of Search ..... 42/70 R, 70 C, 70 D, 42/70 E, 70 F; 89/143, 148, 149, 154

[56] References Cited

U.S. PATENT DOCUMENTS

| | | | |
|---|---|---|---|
| 853,073 | 5/1907 | Esser | 42/70 R |
| 1,786,536 | 12/1930 | Holek | 89/143 |

*Primary Examiner*—Charles T. Jordan
*Attorney, Agent, or Firm*—B. Deon Criddle

[57] ABSTRACT

A safety device for rifles that will hold the breechblock thereof in a locked, open position, after firing, for so long as the firing pressure on the trigger is maintained. The safety device also utilizes the rifle safety actuator to hold the breechblock in its locked open position when the actuator is in its "safe" position or to release the breechblock after the rifle safety actuator has been placed in its "fire" position and the trigger pressure has been released. Normal operation of the rifle safety actuator is not affected.

5 Claims, 4 Drawing Figures

SAFETY DEVICE FOR RIFLES

BRIEF DESCRIPTION OF THE INVENTION

1. Field of the Invention

This invention relates to safety devices on semi-automatic firearms which operate to lock the bolt or breechblock into an open position and prevent chambering of a cartridge.

2. Prior Art

Safety devices for semi-automatic firing rifles are not uncommon and generally use a combination of locking devices operated by direct application of force upon the breechblock to lock the breechblock into an open position, and a button operated thumb or finger safety which locks the trigger so that the rifle will not fire.

To the best of my knowledge no one, in the past, has recognized the desirability of a device which operates to hold the breechblock in the open position after firing by holding the trigger in a pulled position and then by operating the rifle safety actuator to lock the breechblock in that open position until the rifle safety actuator is again moved to its "fire" position where it will allow forward movement of the breechblock.

SUMMARY OF THE INVENTION

It is the principle object of the present invention to provide a safety device for rifles such as a Ruger 10/22 caliber semi-automatic, which will operate to lock the rifle breechblock in an open position when the pressure applied to pull the trigger is maintained after firing, and which can subsequently be easily locked into that position by operation of the rifle safety actuator.

Other objects are to provide a breechblock locking device that is easily constructed from inexpensive materials and that can be readily installed in a conventional rifle such as a Ruger 10/22 caliber semi-automatic either during initial construction thereof or subsequent to construction and that can be readily removed by the user should he so desire.

Still another object is to provide a breechblock locking device which can be operated by simple trigger pull after firing and which will continue holding the breechblock in the open position so long as the firing trigger pressure is continously maintained.

Still another object is to provide contact with rifle safety, an assembly which incorporates the rifle safety actuator, such that when the actuator is placed in its "safe" position, will lock the breechblock in the open position and will continue to hold the breechblock in that position, without effort on the part of the operator, until the actuator is placed in its "fire" position, to thereby release the breechblock.

Principal features of the invention include a pivoted breechblock locking device arranged to be pivotally connected into the receiver of a rifle and to be pivoted to a raised position by operation of the rifle trigger. A sear finger is pivotally carried by the breechblock locking device and is spring biased into engagement with a shoulder on the rifle breechblock when the trigger is pulled and the breechblock is in its opened position. A slide assembly, which comprises the usual rifle safety actuator, is moved to wedge beneath the breechblock locking device and to thereby hold the sear finger in engagement with the open breechblock. When the pull on the trigger is released, the breechblock will be held open by the rifle safety actuator until the actuator has been operated to move it to its "fire" position. Use of the present invention does not require any change in existing rifle structure and merely involves a direct replacement of the manufacturers breechblock rearward detention apparatus.

Further objects and features of the invention will become apparent from the following detailed description, taken together with the accompanying drawings, disclosing what is presently contemplated as being the best mode of the invention.

THE DRAWINGS

In the drawings:

FIG. 1 is a vertical section view through a portion of a rifle receiver area and showing the rifle breechblock, fragmentarily, in a locked open position;

FIG. 2, a similar view, but with the breechblock in a closed position;

FIG. 3, a fragmentary, perspective breechblock locking device and showing the slide assembly, with the locking device in its lowered position; and FIG. 4, a view like that of FIG. 3, but showing the locking device in its raised position.

DETAILED DESCRIPTION

Figure 1:
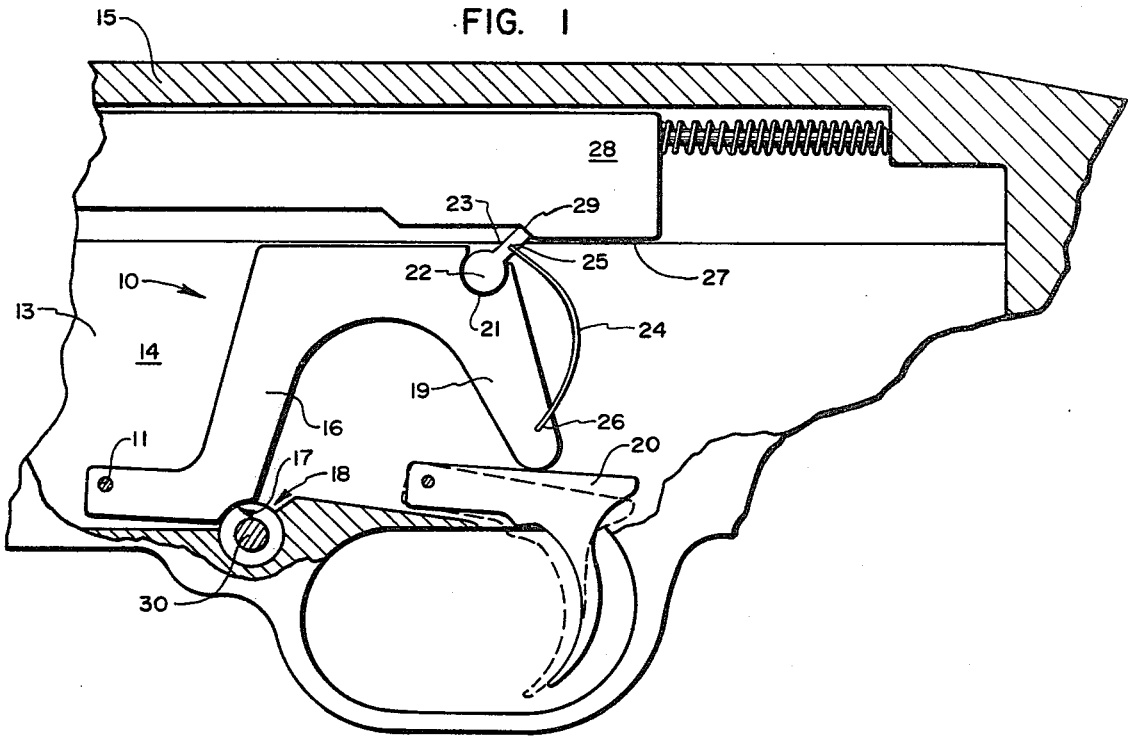
Figure 2:
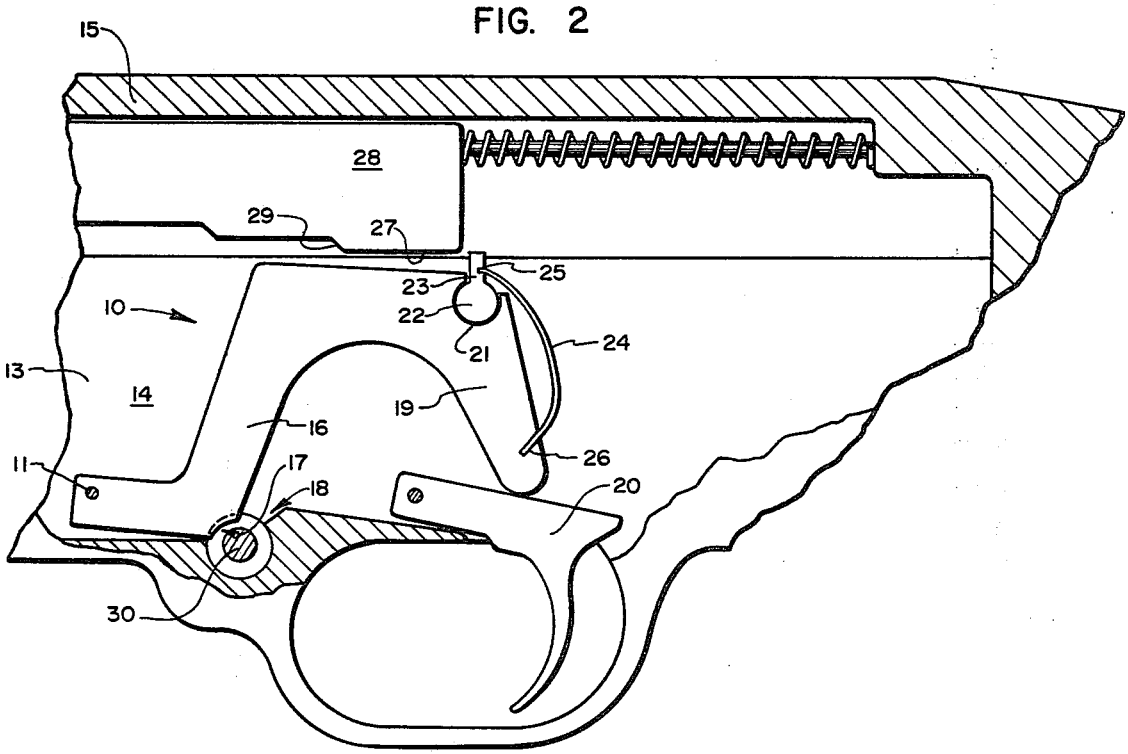

Referring now to the drawings:

In the illustrated preferred embodiment, the safety device of the invention includes a breechblock locking device, shown generally, at 10. The breechblock locking device is pivoted on a pivot pin 11 that extends between side walls 12 and 13 of a receiver 14 of a rifle, such as a Ruger, semi-automatic 10/22 caliber rifle, shown fragmentarily at 15. The locking device is shaped to allow for clearance of other components in the rifle chamber and as shown includes a leg 16 arranged to be engaged by an enlarged portion 17 of the rifle safety actuator shown generally at 18 and a hook 19 projecting from the leg 16 and with its free end arranged to rest on top of a conventional, pivoted rifle trigger 20.

A socket 21 is formed in an upper edge of the locking device and a cylindrical or spherical swivel member 22 is captively positioned in the socket. A sear finger 23 projects from the swivel member and a flat spring 24 has one end fitted into a notch 25 provided therefore in the sear finger and its other end secured in a notch 26 formed in one edge of the hook 19. The spring 24 thus biases the sear finger towards an upwardly projecting position where it is adapted to engage the undersurface 27 of the conventional breechblock 28 of the rifle.

The breechblock 28 has an inclined shoulder 29 on the undersurface thereof, which shoulder is adapted to be engaged by the end of the sear finger 23 when the trigger 20 is pulled and held in its pulled position, as shown in solid lines in FIG. 1, and when the breechblock has moved to its opened position. However, when the trigger is in its forward (i.e. unpulled) condition and the breechblock locking device is not held in a raised position by the rifle safety actuator 18, the sear finger 23, even though rotated to a fully upright position, will allow unrestricted movement of the spring biased breechblock to its closed position.

Figure 3:
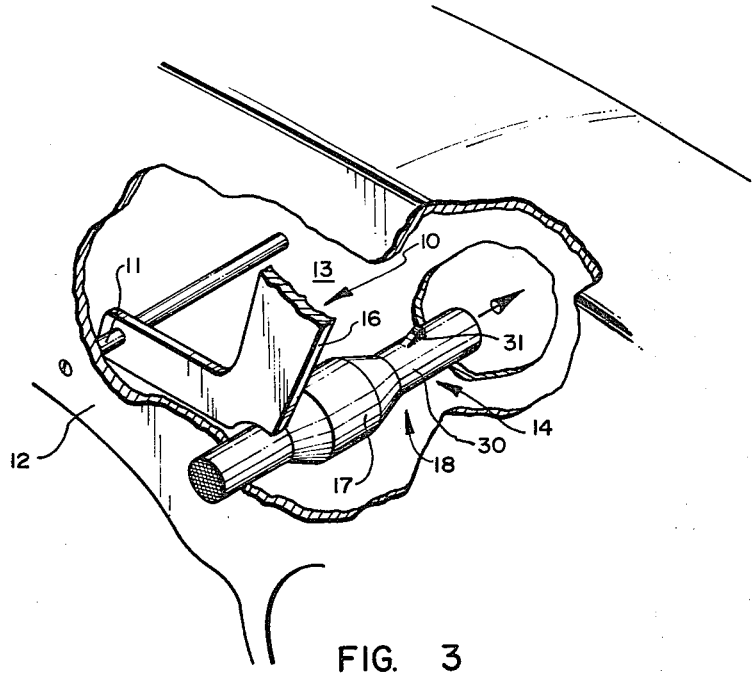
Figure 4:
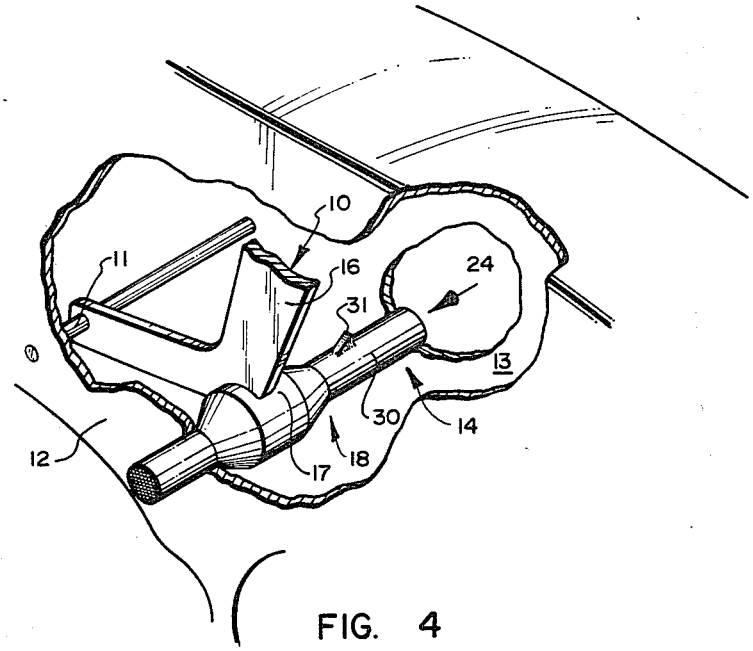

As shown best in FIGS. 3 and 4, the rifle safety actuator 18 has a shaft 30 that extends through the opposite side walls 12 and 13 of the receiver 14 and that is beneath the breechblock locking device 10. An upset portion 31 on the shaft 30 engages wall 13 to limit travel of the shaft 30 through that wall and the gradually enlarged portion 17 on the shaft 30 will move under the breechblock locking device 10 to engage the breechblock 28.

While the upset portion 31 has been shown as a means for holding the rifle safety actuator within the rifle receiver, any other conventional arrangement can be used. Various snap acting and one-center detents have been proposed in the past for positively holding the rifle safety actuator in either its "safe" position, wherein the breechblock cannot move and its "fire" position, where the breechblock is free to move during the firing cycle of the rifle.

As the enlarged portion 17 moves under the breechblock locking device 10 it wedges it upwardly. When the breechblock 28 is in its closed position it is moved from above the sear finger 23 and the shaft 30 can be moved to place the rifle in a "safe" condition in customary fashion, or can be positioned to allow for conventional firing of the rifle. When the breechblock is moved to its opened or rearmost position by pulling on the trigger to fire a shell, thereby opening the breechblock, the sear is rotated by the rearwardly moving breechblock, against the bias of spring 24 to allow the breechblock to pass over. The breechblock is then held in position by the trigger 20 continuing to engage hook 19 such that the breechblock locking device will be raised to allow the sear finger 23 to be biased by spring 24 into engagement with shoulder 29 on the bottom of the breechblock after the shoulder has moved past the sear finger. The rifle safety actuator can be manipulated by pushing shaft 30 until the enlarged portion 17 is beneath the breechblock locking device 10 to continue to hold it in its opened position even after pressure on the trigger 20 is released.

With the safety device of the present invention semi-automatic rifles of the type described that normally chamber a new round immediately after firing and that are then normally placed in a loaded safety condition by manipulating a slide assembly safety to prevent firing can be easily placed in an unloaded safe condition thereby making discharge impossible. If the user simply locks the breechblock in the open condition at time of firing the rifle, holding the trigger in the firing position, and manipulating the slide to allow the sear finger to engage and hold the shoulder on the bottom of the breechblock, as has been described, he can then pull the usual magazine (not shown) fully or partially from the rifle before allowing the breechblock to again move forward by moving the rifle safety actuator to "fire" position. The rifle is then in an unloaded condition and is much safer to handle than it would be if a new shell had been positioned in the chamber. Also the unloaded rifle is then legal for transport in motor vehicles.

Although a preferred form of my invention has been herein disclosed, it is to be understood that the present disclosure is made by way of example and that variations are possible without departing from the subject matter coming within the scope of the following claims, which subject matter I regard as my invention.

I claim:

1. A safety device for rifles having a reciprocating breechblock with a shoulder on the bottom thereof positioned within a walled receiver and a trigger, said safety device comprising a breechblock locking device;

means pivotally mounting said breechblock locking device within the receiver beneath the breechblock and to have at least a portion thereof in engagement with the trigger whereby pulling of the trigger will raise the breechblock locking device; and means on the breechblock locking device to engage the shoulder on the bottom of the breechblock when the breechblock is in an opened position to thereby hold said breechblock in the opened position.

2. A safety device for rifles as in claim 1, further including means for holding the breechblock locking device in its raised position after being raised by pulling of the trigger.

3. A safety device for rifles as in claim 2, wherein the means on the breechblock locking device to engage the shoulder on the bottom of the breechblock includes a sear finger;

means pivotally mounting the sear finger to project upwardly from the breechblock locking device;

means biasing the sear finger to project upwardly from the breechblock locking device to engage the bottom of the breechblock.

4. A safety device for rifles as in claim 3, wherein the means pivotally mounting the sear finger to project upwardly from the breechblock locking device comprises a socket formed in an upper edge of the breechblock locking device; and a swivel member attached to the sear finger and secured for rotation in the socket.

5. A safety device for rifles, as in claim 4, wherein the means for holding the breechblock locking device in its raised position after being raised by pulling of the trigger includes the usual rifle safety actuator having a shaft mounted beneath the breechblock locking device and extending through the rifle receiver, said shaft being selectively slidable to move an enlarged portion thereof beneath the breechblock locking device to thereby force the breechblock locking device to remain raised, and to hold the breechblock in an open position when the rifle safety actuator is in its usual "safe" position and from under the breechblock locking device when the rifle safety actuator is returned to "fire" position.

* * * * *